United States Patent [19]

Wilmers

[11] 3,990,246

[45] Nov. 9, 1976

[54] DEVICE FOR CONVERTING THERMAL ENERGY INTO MECHANICAL ENERGY

[75] Inventor: Gottlieb Wilmers, Neuenstadt, Germany

[73] Assignee: Audi NSU Auto Union Aktiengesellschaft, Neckarsulm, Wurttemberg, Germany

[22] Filed: Mar. 3, 1975

[21] Appl. No.: 555,050

[30] Foreign Application Priority Data

Mar. 4, 1974 Germany ..... 2421398

[52] U.S. Cl. ..... 60/707; 60/521

[51] Int. Cl.[2] ..... F02G 1/04

[58] Field of Search ..... 60/521, 522, 698, 707, 60/706

[56] References Cited

UNITED STATES PATENTS

| | | | |
|---|---|---|---|
| 2,616,243 | 11/1952 | Van Weenan | 60/521 |
| 3,636,719 | 1/1972 | Sato | 60/521 X |
| 3,678,686 | 7/1972 | Buck | 60/521 |

FOREIGN PATENTS OR APPLICATIONS

| | | | |
|---|---|---|---|
| 604,214 | 6/1926 | France | 60/521 |
| 439,066 | 1/1927 | Germany | 60/521 |
| 9,919 | 4/1907 | United Kingdom | 60/521 |

*Primary Examiner*—Martin P. Schwadron
*Assistant Examiner*—H. Burks, Sr.
*Attorney, Agent, or Firm*—Kane, Dalsimer, Kane, Sullivan and Kurucz

[57] ABSTRACT

A device for converting thermal energy into mechanical energy in a cycle process. A gaseous working medium is pushed from a hot space through a line containing a heater, regenerator and cooler through a cold space and thereafter pushed back through the same line into the hot space by a piston. The cold space is connected to a high pressure tank and a low pressure tank by two check valves operating in opposite directions. The pressure tanks are connected in turn to the inlet and the outlet respectively of an expansion engine.

7 Claims, 3 Drawing Figures

DEVICE FOR CONVERTING THERMAL ENERGY INTO MECHANICAL ENERGY

BACKGROUND OF THE INVENTION

The invention relates to a device for converting thermal energy into mechanical energy in a cycle process, wherein a gaseous working medium is pushed from a hot space through a heater, regenerator and cooler into a cold space and thereafter pushed back through the same passage into the hot space through the action of a piston.

One cycle process of this type is the well known Stirling cycle process, which is carried out in a cylinder equipped with a displacement piston and a working piston, wherein the cold space is located between the two pistons and the hot space is located between the displacement piston and the cylinder head. The volumes of the hot space and the cold space are periodically changed by a phase shifted hub movement of the two pistons. The output from this engine is picked up by the shaft which is connected to the two pistons through a rhombic drive.

Quite apart from the difficulties involved, especially in a single cylinder engine with a rhombic drive, it is also difficult to regulate r.p.m. and torque in an engine operating on the principle of the Stirling method. Optimized control by change in heat supply is too sluggish and therefore feasible in exceptional cases only. It has therefore been suggested to perform the control by changing the pressure level. This, however, requires an additional pressure pump and a pressure tank. Finally, one may also consider a bypass type control, which however must be regarded as a pure loss control, one which correspondingly reduces the efficiency. It is for these reasons that the Stirling method has not yet found widespread acceptance, in spite of its high thermodynamic efficiency and other advantages; for vehicle engines where fast load and r.p.m. changes are required, the suitability of the method is fundamentally questionable.

SUMMARY OF THE INVENTION

The aim of the invention is to create a device of the type described in the introduction, one that has a high efficiency — similar to an engine operating on the basis of the Stirling principle — but which permits quick changing of r.p.m. and load so that it becomes suitable for the propulsion of a motor vehicle.

According to the invention this aim is realized by connecting the cold space with a high and a low pressure tank through two check valves operating in opposite directions and which are connected in turn to the inlet and the outlet, respectively, of the expansion engine.

While in the Stirling hot gas engine, as explained above, the working and the power engine (working piston and displacement piston) are combined in a single unit, in the device covered by the invention the working engine is separated from the power engine by high and low pressure tanks so that the working engine may be regulated without affecting the power engine (compression unit). The tanks between the compression unit and the expansion engine, operated in conjunction with the device covered by the invention for motor vehicle propulsion, permit energy storage during sliding operation, i.e., low attrition and loss braking. The tanks also eliminate the effects of the unevenness inherent in a one cylinder engine, eliminating the need for expensive multiple cylinder displacement units. In addition, the idea embodied in the invention has the advantage that, unlike other thermal propulsion units (steam engine, combustion engine, gas turbine), the expansion engine admits gas at relatively low temperature.

Another feature of the invention is an additional pressure tank which may be connected either to the low pressure tank or the high pressure tank, as desired. By connecting this additional reservoir one may vary the torque by changing the pressure level in the closed system.

Different drive speeds may be obtained by changing the volume flow (throughput) through varying the drive r.p.m. of the compression unit.

In applications requiring a very fast responding control, for example in motor vehicle propulsion systems, the expansion engine chosen should have an adjustable filling stroke/expansion stroke ratio.

If the dimensions of the pressure tank or the layout of an additional pressure tank are properly chosen, and if an expansion engine capable of being regulated in the manner described above is used, the compression unit may be relatively small since it need be designed not for maximum power but only for average power since maximum power may be obtained by controlling the inflow to the expansion engine and, if need be, by connecting the additional pressure tank.

In practice, the device covered by the invention preferably has a stroke piston driven by a crank drive, housed in a cylinder and bounded at its bottom by the hot space and at its other end — from where the piston rod emerges — by the cold space, and where the space accommodating the crank drive forms the high pressure or low pressure tank. This design eliminates the need for the otherwise necessary hermetic seal between the working spaces of the compression unit and crank space. The crank shaft is preferably connected to an electric motor which functions as a motor when the device is started and as a generator when the device is in operation. By controlling the r.p.m. of the electric motor during operation, one is in a position to accomplish by simple means the above described change in volume flow for varying the drive r.p.m. During the operating phases where the electric motor functions as a generator, it generates electric power which may be utilized for the operation of the fuel and air supply systems of the heater.

In order to prevent the escape of the working medium — which usually consists of hydrogen or helium — by simple means, it is desirable to place the electric motor in the crank space or mount it in the form of a flange motor tightly in an opening of the crank space wall, so that the need for sealing a shaft emerging from the space is eliminated.

Additional details and features of the invention are presented in the description that follows, in conjunction with the drawings.

DESCRIPTION OF THE PREFERRED EMBODIMENT

Figure 1:
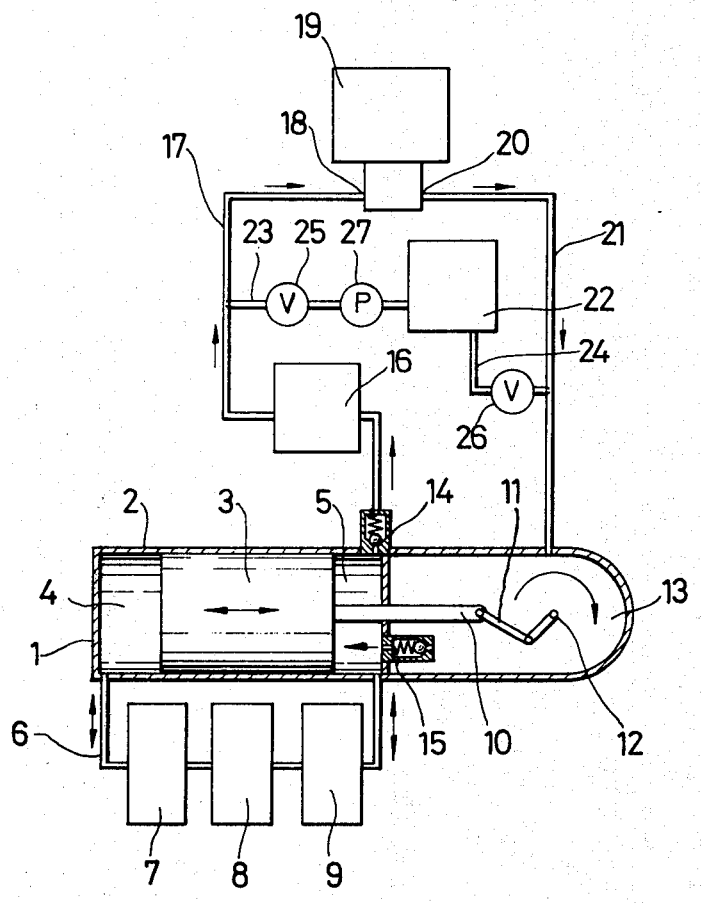
FIG. 1 is a schematic rendering of a device covered by the invention for conversion of thermal energy to electric energy.

Reference is first made to FIG. 1, in which 1 denotes the compression unit, which has a compression cylinder 2 and a longitudinally movable compression piston 3 inside it, the two forming a hot space 4 and a cold space 5 separated from each other by the piston 3 and connected to each other by a line 6 containing a heater 7, a regenerator 8, and a cooler 9. The latter three aggregates are those conventionally used in Stirling type hot gas engines. The compression piston 3 is connected to a crank shaft 12 through a piston rod 10 and a connecting rod 11. The crank drive, 11, 12 is housed in a crank space 13.

The cold space 5 is connected by means of check valves operating in opposite directions 14 and 15 to a high pressure tank 16 and the crank space 13, which in this embodiment serves as a low pressure tank. As can be seen, the check valves 14 and 15 are designed so that the gaseous working medium can only flow from the cold space 5 to the high pressure tank 16 and from the low pressure tank 13 to the cold space 5. The high pressure tank 16 is connected to the inlet 18 of an expansion engine 19 through a line 17. Outlet 20 of the expansion engine is connected to the low pressure tank 13 through a line 21. The expansion engine 19 may be of any conventional design, built for example as a stroke piston or rotary piston engine. The compression stroke/expansion stroke ratio is preferably variable to permit rapidly responsive control of load and r.p.m. by simple means. Between the high pressure tank 16 and the low pressure tank 13 an additional pressure tank 22 may be connected. To permit this to be accomplished, valves 25 and 26 are provided in the lines 23 and 24, which may be operated as desired. The additional tank 22 may be filled through the valve 25 and by means of the valve 26 it may be connected to the low pressure side of the system. If so desired, a compression pump 27 may also be provided in the line 23.

The device operates in the following manner:

If the compression piston 3 is moved at start by driving the crank shaft 12 by means of a starter motor (not shown) upwards (in the drawing, to the left), the gas contained in the hot space 4 is pushed into the cold space 5 through the line 6, whereby it passes through the heater 7, the regenerator 8, and the cooler 9. The pressure in the compression unit drops in the process. When a specific pressure is reached, the check valve 15 is opened and working gas is drawn in from the low pressure tank 13 into the cold space 5, until the piston 3 reached its upper dead center position, i.e., until the hot space 4 has its minimum volume. In the subsequent downward movement of the piston 3, which is accomplished by the usual inert mass of the crank shaft 12, the working gas flows through the line 6, and thus through the cooler 9, the regenerator 8, and the heater 7, whereby the temperature as well as the pressure increase in the entire system until the opening valve of the check valve 14 is reached and the operating gas is free to flow into the high pressure tank 16 and from there to the expansion engine 19.

Figure 2:
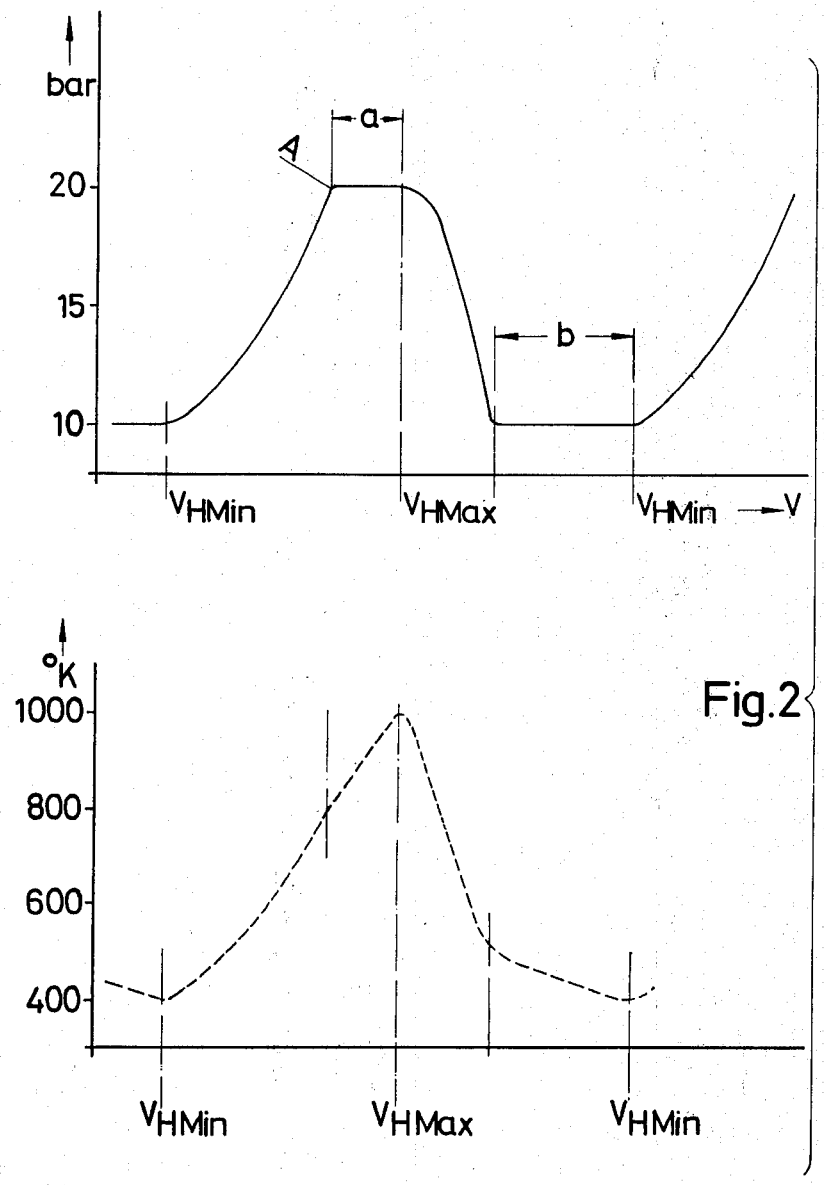
FIG. 2 is a diagram showing the pressure and temperature course in the compression unit as a function of the volume of the hot space.

In the diagram illustrated in FIG. 2 we see the course of the average pressure changes in the compression unit, specifically as a function of hot space volume, whereby said average pressure is the arithmetic mean of the pressures in the hot space, the cold space, and the line 6. $V_{Hmax}$ denotes the maximum hot space volume and $V_{Hmin}$ denotes the minimum hot space volume. Starting from $V_{Hmin}$, the average pressure increases to a value of, e.g., 20 bar, which is determined by the counterpressure at the valve 14. Thus, the valve 14 opens at the location A, and the pressure remains constant up to $V_{Hmax}$. During this section A therefore, the operating gas is expelled under a pressure of 20 bar into the high pressure tank 16. After $V_{Hmax}$ the pressure drops to the value at which the check valve 15 opens, for example to 10 bar. Until $V_{Hmin}$ is reached, the pressure remains at this level, whereby the working gas is drawn in from the low pressure tank 13. The next cycle begins at $V_{Hmin}$. How this pressure course develops is illustrated by the course marked with dashed lines for the average temperature in the compression unit. Average temperature is defined as the temperature obtained from the total heat content of the working gas in the compression unit. At $V_{Hmin}$ a very small amount of gas has the temperature of 1200° K in the hot space, in our example, and the bulk of the gas has the temperature of 350° K in the cold space, in our example. The average temperature obtained is 400° K. As the hot space increases, the charge shifts through the cooler 9, the regenerator 8, and heater 7 in the hot space, and a larger amount of the charge is heated to the hot space temperature, which increases constantly until the total amount of gas reaches an average of 800° K. This doubling of temperature also causes a doubling of pressure since the process proceeds in an isochor manner, the two valves 14 and 15 being closed. Subsequently the average temperature of the charge in the compression unit continues to increase since further amounts of charge enter the hot space and since cold charge leaves the compression unit through the opened check valve 14. After reaching $V_{Hmax}$, the charge is pushed into the hot space; as a result, the temperature decreases until the aspiration begins. Further temperature decrease takes place during the aspiration phase.

Figure 3:
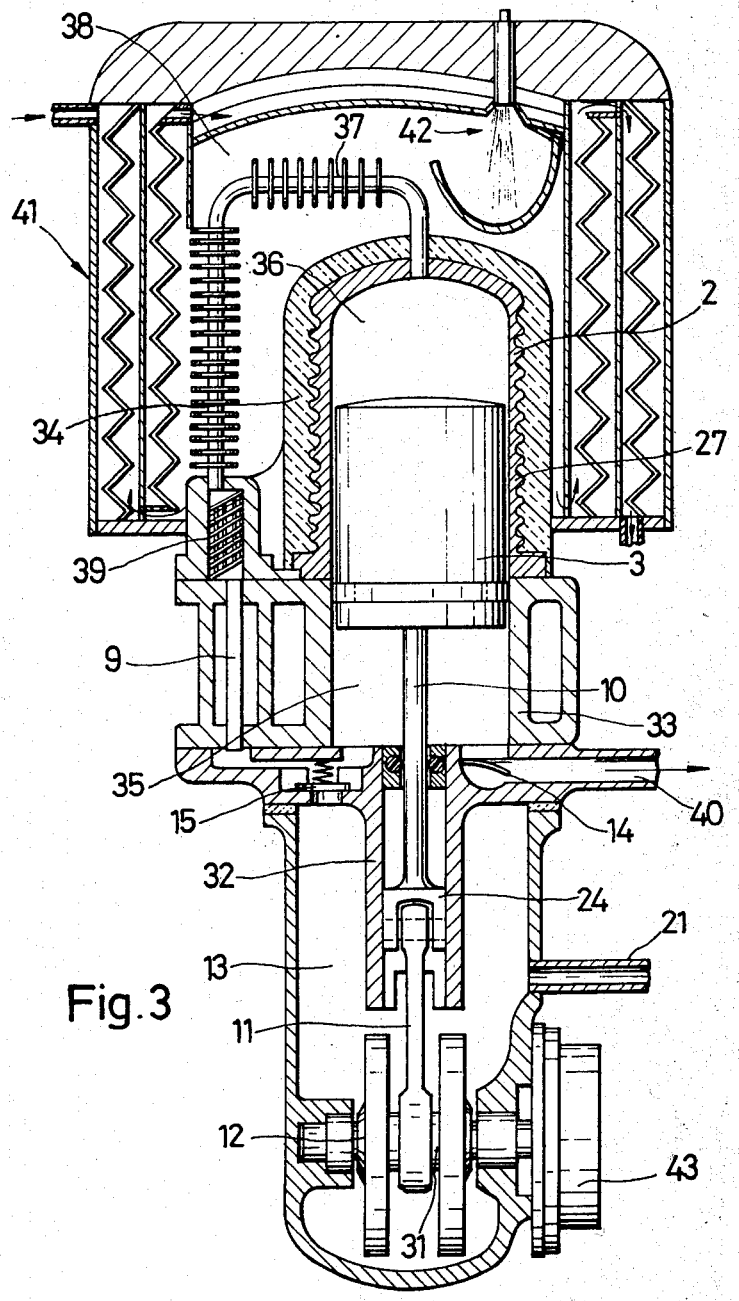
FIG. 3 is a longitudinal section of an embodiment of the compression unit.

FIG. 3 shows a constructive embodiment of the compression unit illustrated in FIG. 1. As in FIG. 1, there is a compression cylinder 2, in which a compression piston 3 executes a reciprocating movement. The compression piston 3 is connected to the crank shaft pin 31 of the crank shaft 12 through a piston rod 10, a crosshead **24*a*, and the connecting rod 11. The crosshead 24*a* is guided in a guide 32 in the conventional manner. The compression cylinder 2 consists of the water cooled cold part 33 and the hot part 34, the latter being thermally insulated from the outside. The compression piston 3 thus separates the cylinder space into a cold space 35 and a hot space 36. Ribbed lines 37 exit from the hot space 36; they pass through the combustion space 38, forming the heater 7 in FIG. 1. They end in the regenerator space 39. From there the gas may pass to the cold space 35 through a cooler 9. From the cold space 35 a line 40 starts; it leads to the high pressure tank 16 in FIG. 1. The check valve 14 is placed in line 40. Moreover, the cold space 35 is connected via the check valve 15 to the crank space 13 which, in the example illustrated in FIG. 1, serves as the low pressure tank. The line 21 in FIG. 1 terminates in the crank space 13 which comes from the outlet side 20 of the expansion engine 19**.

The hot part 34 of the compression cylinder 2 is surrounded by an air heater 41 for combustion air, which is transported by a blower (not illustrated) to a burner 42, e.g., a conventional high pressure oil atomization burner. The hot combustion gases in the combustion space 38 heat, as mentioned earlier, the working gas flowing through the ribbed tubes 37, and then — in the air heater 41 — the combustion air, after which they flow outside through an exhaust nozzle, which is not illustrated.

The crank shaft 12 is coupled to an electric motor 43, which may release power when operating as a starter or perhaps a control motor, or receive power — and then operate as a generator — when the device is in operation. The current generated in the process may be used to operate the fuel pump and the combustion air blower of the burner, or other accessories.

Same as in the Stirling type hot air engine, the regenerator 8 serves to absorb the heat content of the inflowing gas and to release this heat as the gas flows back.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. Device for the conversion of thermal energy into mechanical energy in a closed cycle process including an expansion engine having an inlet and outlet, comprising; a housing containing a hot space and a cold space and a movable piston means mounted between said spaces, a gaseous working medium, a line containing a heater, a regenerator and a cooler connected at one end to the hot space and at the other end to the cold space, the piston means being connected to a crank drive and adapted to push the gaseous medium from the hot space through the line to the cold space and thereafter push the gaseous medium back through the line into the hot space, a high pressure tank connected to the cold space by means of a first check valve, a low pressure tank connected to the cold space by means of a second check valve, the two check valves operating in opposite directions, the inlet of the expansion engine connected to the high pressure tank and the outlet of the expansion engine connected to the low pressure tank, and an electric control motor coupled to the crank drive with the electric motor operating as a motor for starting the device and for adjusting the frequency of the piston means as well as a generator during operation of the device.

2. The device according to claim 1 wherein an additional pressure tank is provided capable of being connected to either the high pressure tank or the low pressure tank as desired.

3. The device according to claim 1 wherein the expansion engine is adjustable with respect to its filling stroke/expansion stroke ratio.

4. The device according to claim 1 wherein the piston means is a stroke piston driven conventionally by a crank drive and arranged in a cylinder with the cylinder bounding the hot space with its bottom and the cold space with its other end, a piston rod connected to the piston and emerging from the other end of the cylinder, a crank drive in the housing located in the crank space and connected to the piston rod with the crank space forming one of the high pressure and low pressure tanks.

5. The device according to claim 4 wherein an electric motor is coupled to the crank shaft with the electric motor operating as a motor during starting and as a generator during the operation of the device.

6. The device according to claim 5 wherein the electric motor is placed inside the crank space.

7. The device according to claim 5 wherein the electric motor is mounted as a flange motor tightly sealed in an opening of the crank space wall.

* * * * *